United States Patent [19]

Gartung

[11] Patent Number: 4,561,229

[45] Date of Patent: Dec. 31, 1985

[54] MODULAR SCREEN ASSEMBLY

[75] Inventor: Clifford W. Gartung, Newport Beach, Calif.

[73] Assignee: Pleion Corporation, Santa Ana, Calif.

[21] Appl. No.: 429,042

[22] Filed: Sep. 30, 1982

[51] Int. Cl.[4] ..... E04H 1/00

[52] U.S. Cl. ..... 52/239; 52/278; 160/135

[58] Field of Search ..... 52/239, 241, 242, 238, 52/278; 160/135

[56] References Cited

U.S. PATENT DOCUMENTS

| | | | |
|---|---|---|---|
| 3,349,528 | 10/1967 | Salt | 52/239 |
| 3,768,222 | 10/1973 | Birum | 52/239 |
| 3,845,601 | 11/1974 | Kostecky | 52/241 |
| 4,161,850 | 7/1979 | Peterson | 52/239 |
| 4,185,430 | 1/1980 | Gartung | 52/239 |
| 4,250,676 | 2/1981 | Presby | 52/239 |
| 4,269,005 | 5/1981 | Timmons | 52/239 |

FOREIGN PATENT DOCUMENTS

| | | | |
|---|---|---|---|
| 2448424 | 4/1976 | Fed. Rep. of Germany | 52/239 |

*Primary Examiner*—John E. Murtagh
*Assistant Examiner*—Kathryn Ford
*Attorney, Agent, or Firm*—Price, Gess & Ubell

[57] ABSTRACT

An improved modular office screen assembly having a plurality of hollow rigid frame members supporting a central panel member is disclosed. The frame members can be interconnected through the use of connector members attached adjacent corner apertures that are dimensionally defined to receive a fastener member of a composite configuration. The fastener member has an upper part of a plastic shell to provide a planar surface contiguous with the frame member and a lower plate member to ensure both strength and retention capabilities to the fastener member.

12 Claims, 5 Drawing Figures

FIG. 1
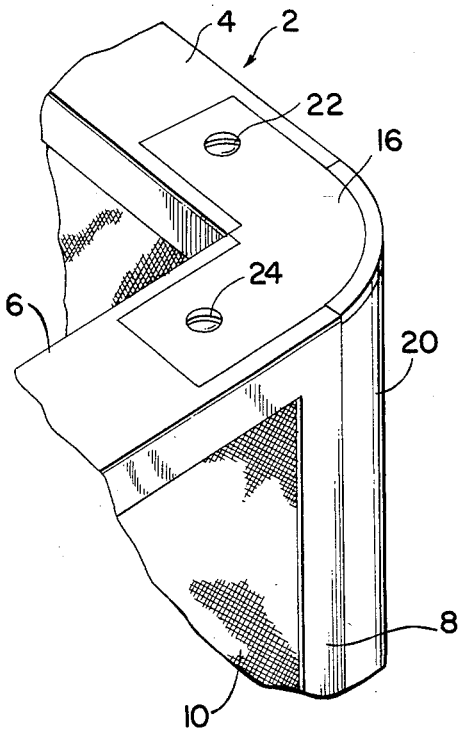
FIG. 2
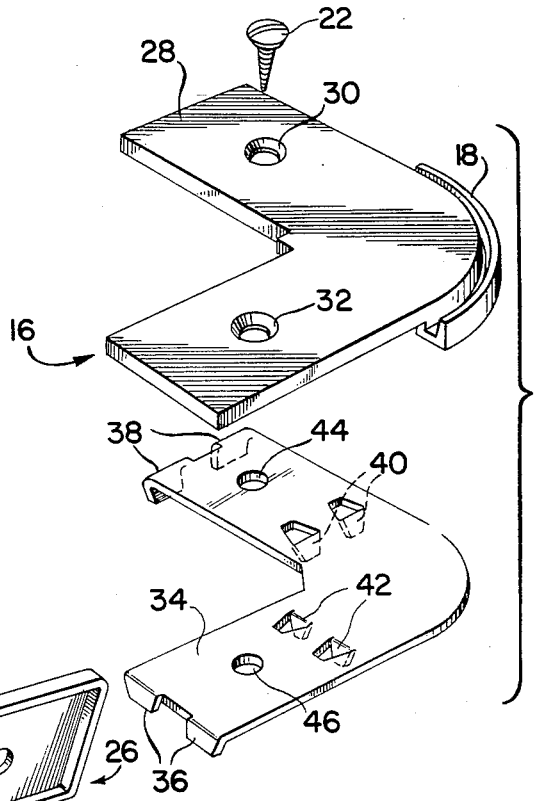
FIG. 5
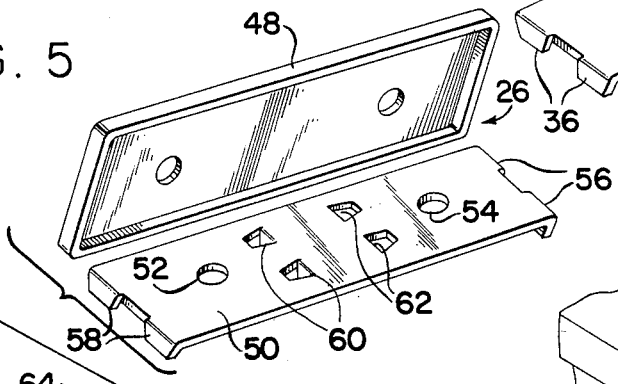
FIG. 4
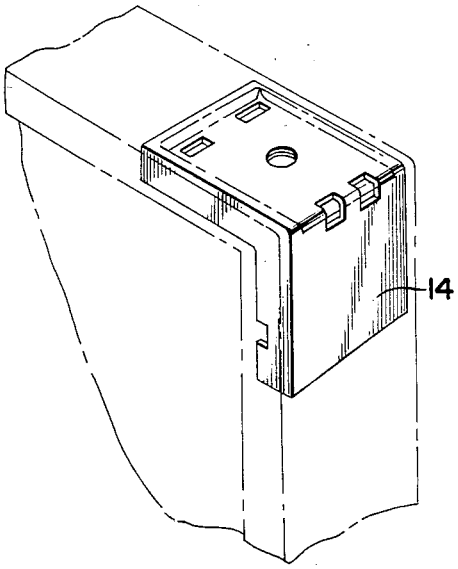
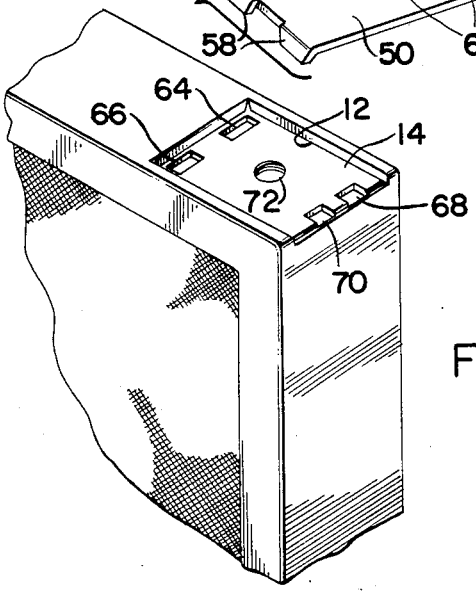
FIG. 3

MODULAR SCREEN ASSEMBLY

BACKGROUND OF THE INVENTION

1. Field of the Invention

The present invention relates to modular office screens for providing movable sound absorbing partitions for offices and the like. More particularly, the invention provides an improved construction of the interface components for adhering individual screen partitions together to create an office matrix.

2. Description of the Prior Art

Various forms of detachable wall or screen partitions are disclosed in the prior art and are used in commercial and residential environments. The following examples of United States patents are representative of various forms of modular office screening systems and wall panels: U.S. Pat. No. 4,102,095; U.S. Pat. No. 4,185,430; U.S. Pat. No. 3,934,382; U.S. Pat. No. 3,428,108; U.S. Pat. No. 3,350,828; U.S. Pat. No. 1,300,722; U.S. Pat. No. 3,768,222; and U.S. Pat. No. 3,766,696.

While the basic function of the modular office screen partition system is well known in the prior art, the designer in this field must realistically consider not only practical and economical aspects, but also the ornamental appearance of the partition systems as well. Thus, while the office partition must be structurally sound, it also must provide a pleasing appearance to the office worker. One of the key areas in providing both structural integrity in an office panel system and in creating problems in achieving an aesthetically pleasing configuration are the joints or components interfacing between the individual frame members that constitute the modular office screen system. These components must be simple for assembly while providing structurally strength and a pleasing appearance. While the above patents are representative of numerous attempts to address these problems, it is clear that there is still a need in the prior art for improvements to the component parts that join the individual modular screens to form a subjective office matrix.

SUMMARY OF THE INVENTION

It is an object of this invention to provide a movable modular screen assembly capable of forming predetermined partition configurations which are both economical to manufacture and practical to assemble.

It is another object of this invention to provide a movable modular screen assembly capable of forming predetermined partition configurations by the use of relatively simple connector components that provide a highly aesthetic appearance.

The above described and other objects and advantages are achieved in the environment of a modular office screen assembly having a number of hollow rigid frame members each supporting a central panel member. Each frame member includes horizontal and vertical sections preferably of a U-shaped channel configuration that support a central panel member that can be a fiberglass or foam pad covered with a decorative fabric. The upper horizontal section of each frame member can have an aperture adjacent each upper corner edge. A connector member configured for mounting at the aperture within each frame member can be attached, for example by welding, to both the vertical column and horizontal column of the frame member. The connector member provides not only a threaded hole for receiving a fastening screw, but in addition, two pair of indexing slots on either side of the hole to prevent any lateral movement between adjacent frame members. A composite fastener member is configured for mounting within the apertures of the horizontal frame sections of the frame members and has an upper decorative plastic shell member that provides a contiguous planar surface with the surface of the frame member. A lower metal plate member completes the fastener member and is mounted within the upper plastic shell member. The lower plate member has a series of downwardly extending tab members and a pair of smooth bores for permitting access of a screw member to the threaded bore of the connector member. The specific shape of the fastener member can be subjectively designed to accommodate two or more modular screens in any predetermined partition configuration. When, for example, two screens form a corner edge, a particular fastener member can have its upper plastic shell member configured to provide a retaining edge for suspending a decorative corner panel to cover the joint.

The objects and features of the present invention which are believed to be novel are set forth, with particularity in appended claims. The invention may be best understood by reference to the following description, taken in connection with the accompanying drawings.

BRIEF DESCRIPTION OF THE DRAWINGS

FIG. 1 is a partial perspective view of a modular screen and fastening member of the present invention;

FIG. 2 is an exploded perspective view of the fastener member of the present invention;

FIG. 3 is an upper perspective view of a corner edge of a frame member having a connector member mounted thereto;

FIG. 4 is a perspective view of a connector member with the frame member disclosed in phantom lines, and FIG. 5 is an exploded view of another form of a fastener member of the present invention showing the bottom perspective of the decorative housing.

DESCRIPTION OF THE PREFERRED EMBODIMENTS

The following specification, taken in connection with the drawing, sets forth the preferred embodiment of the present invention in such a manner that any person skilled in the modular screen manufacturing field can use the invention. The embodiments of the invention disclosed herein represent the best mode contemplated by the inventor for carrying out his invention in a commercial environment, although it should be understood that various modifications can be accomplished within the parameters of the present invention.

Referring to FIG. 1, an assembled corner of a modular office screen assembly 2 is shown from an upper perspective view. The individual frame members that constitute each panel member have horizontal sections 4 and 6 respectively that are supported by respective vertical frame members such as 8. A central panel 10 can be a fabric covered glass fiber pad or plastic foam pad of any subjective decorative design. The frame members are of a substantially U-shaped metal channel configuration that is usually welded together to provide a relatively rigid frame. Each of the upper corner edges of the frame members 4 and 6 have a rectangular aperture such as the aperture 12 shown in FIG. 3. Mounted across the bottom of the aperture is a connector member 14 to be described herein to provide a recess on the surface of the horizontal sections.

A fastener member 16 is configured to fit within the respective apertures of adjacent horizontal frame members and to rigidly secure the frame members into the desired office matrix. In the perspective of FIG. 1 only two frame members are interconnected by the fastener member 16. As can be readily appreciated three or four members with an appropriate modification of the shape and configuration of the fastener member can be accommodated and are well within the parameters of the present invention. In the case of connecting only two frame members to form a corner configuration, the fastener member 16 can be provided with an outer retaining edge 18 that is adapted to support and suspend a decorative end cover 20 to cover the spaced opening or joint between the vertical frame members.

A pair of metal screws 22 and 24 are used to secure the fastener member 16 to respectively each of the horizontal frame members 4 and 6. As can be readily seen in FIG. 1, the mounting of this fastener member 16 provides a contiguous planar surface with the outer horizontal periphery of the horizontal section of the respective frame members and provides a simple connection with a highly pleasing appearance. The fastener member 16 when appropriately inserted into a pair of frame members lies in the same plane as the outer horizontal periphery of the horizontal section of the frame members. The design of an aperture with the mounting of respective internal connecting members in each of the upper corner edges of the horizontal frame sections creates a cavity for receiving the fastener member 16 and further cooperates in providing rigidity to the modular office screen system.

To ensure that there will be no relative lateral movement between adjacent frame members the fastener member 16 is actually a composite of two separate parts. Referring specifically to FIGS. 2 and 5, the upper or first part that forms the contiguous planar surface can be advantageously molded of plastic to form a plastic shell having a cavity for receiving a second metal plate part. These respective parts can be secured together by adhesive or other appropriate means and together provide a composite fastener member, as seen respectively as the fastener member 16 in FIG. 2 and fastener member 26 in FIG. 5. The upper plastic shell member 28 can have integrally molded apendages such as the retaining edge 18 as shown in FIG. 2. Additionally beveled bores 30 and 32 can be easily provided during molding. The lower metal plate 34 can be stamp-pressed during formation to provide outer retention tabs 36 and 38 and also a pair retention tabs 40 and 42. Finally a pair of threaded bores 44 and 46 can be drilled or punched through the metal plate to permit passage of the screws.

Referring to FIG. 5, another possible configuration of a fastener member 26 is disclosed. The upper plastic shell member 48 forms a rectangular box configuration for covering and encircling the lower metal plate 50. A pair of bores 52 and 54 are positioned between indexing tab means. The outer tab members 56 and 58 are equally spaced as in the embodiment of FIG. 2 with inner tab members 60 and 62. As can be appreciated, the outer edge tab members are designed to interface with slots 64 and 66 in the connector member 14 such as shown in FIG. 3 while the inner tab members are designed to interface with slots 68 and 70. The connector member 14 has at least one threaded bore 72 that is designed to coact with a fastener screw.

Referring to FIG. 4, the connector member 14 has a side L-shaped configuration and a cross-sectional U-configuration that can be attached to the inner surface of the frame members, for example, by welding. A pair of side tabs 74 extend inward, one of which is shown in FIG. 4, to provide guide members during the installation of the connector member 14 within its frame member. The position of the connector member further provides support and rigidity to the corner of the frame member and assures a solid stationary base for anchoring any fastener members.

While we have been discussing the upper fastener connections in an office panel system that are readily apparent to the observer's eye, it should be appreciated that lower fasteners that also interconnect the respective frame members are also frequently utilized in office screen modular partitions. These fastener members, however, can be of a conventional design and are not as readily visible to present aesthetic problems in providing a subjective office environment. For example, lower fastener members such as disclosed in U.S. Pat. No. 3,934,382, the specification of which is hereby expressly incorporated into this disclosure by reference, can be utilized.

To assembly a pair of panels to form a 90° corner for an office environment, the respective panels are aligned as shown in FIG. 1 and a fastener member such as fastener member 16 can simply be inserted into the respective apertures of the adjacent frame members. By the simple provision of a pair of fastening metal screws 22 and 24, the fastener member can securely position the respective frame members in the desired configuration. Prior to the insertion of the metal screws, the tab members on the lower metal plate portion of the fastening member 16 are inserted into the respective complimentarily slots positioned on either side of the threaded bore of the connector member. With the insertion of the metal screws, the tab members or indexing members prevent any lateral or relative movement between the respective frame members. As can be readily seen, the upper planar surface is contiguous with the planar surface of the respective horizontal sections of the frame members. The use of a plastic housing shell, for example, of a polycarbonate material ensures a highly pleasing configuration while still assuring the convenience of a relatively quick assembling and disassembling of the partition assembly. The use of the connector member 14 in combination with composite fastener members that can be of various configurations ensures a highly advantageous modular screen assembly within practical economical restraints.

The above modular screen system is capable of being assembled within a few steps while still providing an aesthetically pleasing decorative appearance. It will be readily apparent to those skilled in this field that various modifications of the present invention are possible and accordingly, the scope of the present invention should be interpreted solely from the following claims.

What is claimed:

1. In an improved modular office screen system having a plurality of hollow rigid frame members, each frame member supporting a central panel member and extending about the periphery of the central panel member to provide horizontal and vertical aligned sections connected together to form corner edges, the improvement comprising:

an upper planar horizontal section of each frame member having at least one aperture limited to an adjacent an upper corner edge;

a connector member having slots configured for mounting within each frame member is attached across the aperture to form a recess in the horizontal section limited to an adjacent corner edge, and a fastener member configured for mounting within and filling the recess of the aperture to provide and upper contiguous planar surface with the outer horizontal periphery of the horizontal section of the frame member, the fastener member having both securement means for securing the fastener member directly to a connector member in each frame member and indexing tab means positioned on either side of the securement means, on the bottom surface of the fastener member and engages said slots in the connector member, for preventing lateral movement between adjacent frame members.

2. The invention of claim 1 wherein the fastener member is bifurcated into two separate parts, the first part forms the upper contiguous planar surface and the second part provides the securement means.

3. The invention of claim 2 wherein the first part is molded of plastic and the second part is a metal plate.

4. The invention of claim 3 wherein the indexing means includes a plurality of tab members extending downward relative to the upper planar surface.

5. The invention of claim 4 wherein the tab members are cut from the metal plate.

6. The invention of claim 5 wherein the securement means includes a pair of holes in the fastener member and a pair of screw members.

7. The invention of claim 2 wherein the plastic portion has a molded retainer edge for suspending an end cover member.

8. The invention of claim 1 wherein the connector member has a U-shaped cross section and is attached to the interior of the frame members adjacent a corner edge to further support the frame member.

9. The invention of claim 3 wherein the plastic part extends over and around the metal plate.

10. The invention of claim 8 wherein the connector member has an L-shaped configuration and further includes guide tabs on either side for positioning the connector member within the frame member.

11. In an improved modular office screen system having a plurality of hollow rigid frame members, each frame member supporting a central panel member and extending about the periphery of the central panel member to provide horizontal and vertical aligned sections connected together to form corner edges, the improvement comprising:

an upper planar surface on the horizontal section of each frame member having at least one aperture limited to an adjacent upper corner edge;

a connector member configured for mounting within each frame member is attached across the aperture to form a recess extending below the planar surface of the horizontal section, the connector member has an inverted elevated side view L-shaped configuration and provides a pair of slots adjacent opposite edges of the recess the horizontal section of the connector member;

a composite fastener member configured for mounting within and filling the recess of the aperture, having an upper plastic shell member providing an upper contiguous planar surface that lies in the same plane as the outer horizontal periphery of the horizontal section of the frame member, and a lower metal plate member mounted within the upper shell member and having both securement means for permitting a fixed securement of the fastener member directly to a connector member in each frame member and indexing tab means positioned on either side of the securement means for preventing lateral movement between adjacent frame members by insertion into the respective slots on the connector member.

12. In an improved modular office screen system having a plurality of hollow rigid frame members, each frame member supporting a central panel member and extending about the periphery of the central panel member to provide horizontal and vertical aligned sections connected together to form corner edges, the improvement comprising:

an upper horizontal section on each of a pair of frame members providing the uppermost planar surface of the screen system and having respective apertures limited to the adjacent of each upper corner edge;

connector members configured for mounting within each frame member and attached across the respective apertures to form a recess on the surface of each of the horizontal sections, each connector member has a pair of slots adjacent opposite edges of its respective recess;

a composite fastener member configured for extending across, mounting within the recesses of a pair of apertures on adjacent frame members, and filling the fastener member having an upper plastic shell member providing an upper contiguous planar surface that lies in the same plane as the outer horizontal periphery of the horizontal section of each frame member, and a permanently attached lower metal plate member mounted within the upper shell member and having both securement means for permitting a fixed securement of the fastener member directly to a connector member in each frame member and a plurality of tab members positioned to extend downward relative to the upper planar surface on either side of the securement means for preventing lateral movement between adjacent frame members by insertion into the respective slots on each connector member.

* * * * *